United States Patent [19]

Battisti et al.

[11] 4,080,246

[45] Mar. 21, 1978

[54] NOVEL ETCHING COMPOSITION AND METHOD FOR USING SAME

[75] Inventors: Angelo J. Battisti, Windsor; Frank J. Loprest, Binghamton, both of N.Y.

[73] Assignee: GAF Corporation, New York, N.Y.

[21] Appl. No.: 700,906

[22] Filed: Jun. 29, 1976

[51] Int. Cl.[2] ..... C23F 1/02

[52] U.S. Cl. ..... 156/656; 156/659; 156/665; 156/904; 252/79.2; 252/79.4; 427/250

[58] Field of Search ..... 252/79.2, 79.4; 156/21, 156/22, 23, 19, 18, 8, 13, 664, 665, 656, 659, DIG. 904; 427/90, 91, 250; 96/35.1

[56] References Cited

U.S. PATENT DOCUMENTS

| | | | |
|---|---|---|---|
| 3,202,612 | 8/1965 | Nelson | 252/79.2 |
| 3,715,250 | 2/1973 | Altman et al. | 156/22 |
| 3,833,434 | 9/1974 | Kikuchi et al. | 252/79.2 |
| 3,905,907 | 9/1975 | Shiga | 156/664 |
| 3,953,263 | 4/1976 | Ishikawa et al. | 252/79.2 |

*Primary Examiner*—William A. Powell
*Assistant Examiner*—Jerome W. Massie
*Attorney, Agent, or Firm*—Walter C. Kehm; Marilyn J. Maue

[57] ABSTRACT

An improved etchant solution for selectively etching unprotected areas of metal film from a substrate which comprises between about 65 and about 90 parts by weight phosphoric acid, between about 0.5 and about 5 parts by weight of a perchloric acid component and between about 9 and about 30 parts by weight water, which composition contains from 0 to about 5% by weight total volume of a neutral or anionic wetting agent. The invention also comprises the method of utilizing the etchant composition and the improved precision device produced thereby.

15 Claims, No Drawings

NOVEL ETCHING COMPOSITION AND METHOD FOR USING SAME

BACKGROUND OF THE INVENTION

Instant invention relates to a composition for selectively etching films of aluminum metal or alloys thereof in the manufacture of microelectronic devices, printed circuits, photolithographic plates and the like. Another aspect of the invention relates to the method of selectively etching unprotected areas of an aluminum film, deposited on the surface of a substrate, with exceptionally fine line dilineation, definition and optical resolution such as is required in the manufacture of relatively small, high precision devices, semi-conductors and integrated microelectronic and printed circuitry.

Typically, the fabrication of devices for microelectronic applications involves etching of a circuit pattern through a thin layer of unprotected aluminum film, or an alloy thereof containing a predominant proportion of aluminum metal. The purpose of the etchant is to selectively remove exposed areas of metal film without injury to other resist coated areas of the film so that on completion of the etching operation and removal of the photoresist coating, there remains unaltered metal film in predescribed areas on the substrate to serve as connecting pins or interconnections in a semi-conductor or circuit device. Generally, the procedure involves coating a substrate such as glass, ceramic, silica, silicon or a plastic or fiber substrate, such as a sheet, with a film of the metal deposited thereon by electroplating, sputtering, evaporation, or lamination to provide a metallic layer of from about 0.5 mu to about 75,000 mu thickness. To protect certain areas of the deposited metal film from chemical attack by acidic solutions there is usually coated over the entire metal film a resist layer, e.g. a photoresist which is sensitive to exposure to light or any other resist material capable of receiving a latent image imparted by a source of energy, such as light, irradiation, electron beam, X-rays, sonar, or heat and capable of being converted from its original form to another such that only exposed areas (positive resist) or unexposed areas (negative resist) can be removed by a developer after exposure to the energy source. A photoresist can be either positive working or negative working and forms an image impressionable layer over the metal film which, in those areas exposed to UV light through a masking device carrying a master pattern, is so modified that a complimentary or corresponding image is registered thereon. The desired areas of the resist are then selectively removed by a developer in which the modified or unmodified portions are soluble but in which the alternate portions are insoluble.

A photoresist is positive working when it reproduces the image, or a reflex copy, of the master pattern by rendering the exposed areas soluble in a given developer in which the unexposed areas are insoluble, and negative working when it reverses the pattern, i.e. by rendering the exposed areas insoluble in a given developer in which the unexposed areas are soluble.

To impart the desired image on the photoresist layer, it is generally covered with a mask or stencil. For example, a patterned shield composed of chromium, a metal or glass on which is deposited in the desired pattern an azo dye, or silver, may be used or any solid opaque material conventionally used for this purpose, apertured in a pattern to provide the desired corresponding or complimentary pattern on the underlaying resist. The resulting assembly is then exposed to the energy source, usually 20 to 500 millijoules/cm$^2$ exposure to UV light at between 280 and 500 nm wavelength.

In the case of a negative photoresist, e.g. a sensitizer containing irradiation polymerizable or crosslinkable material such as polyvinylcinnamate, a propargyl polymer, an ester of polyvinyl alcohol, a cyclized rubber derivative, an allyl ester prepolymer, etc., the light-exposed portions polymerize or crosslink and thus become insoluble in the developing fluid chosen as the solvent for the process. Conversely, in the case of a positive photoresist which is normally insoluble in the developing fluid, e.g. a diazo oxide or diazide sensitizer-containing polymer such as a novalak resin, an acrylic polymer, copolymer or interpolymer having free carboxyl groups, a polyamic acid condensation product, a styrene-maleic anhydride copolymer, an isoprene polymeric mixture, etc., the light exposed portions are converted to areas of substantial solubility in the selected developing fluid.

After removing the exposed, or unexposed portions of the resist with the developing fluid, the corresponding areas of uncoated metal film are subjected to etching, followed by removing the remaining resist layer from the coated, unetched portions of the film with a suitable solvent, e.g. acetone, carbon tetrachloride, ethyl ketone, chloroform, methylethyl ketone or dimethyl formamide or any other convenient and suitable solvent. The device is thus prepared for implantation of wiring in the etched portions or channels and connected through the areas of metal film remaining on the substrate which act as supports and interconnectors in the circuitry.

It is readily understood that a high degree of accuracy and line resolution with complete and uniform removal of metal from desired portions of the pattern is demanded of the etchant. Numerous etchants and many costly procedures have been proposed to effect complete removal of the metal film in the desired portions while at the same time avoiding undercutting and lifting of the resist-coated metal film at the boundaries delineating the exposed and unexposed areas.

While certain costly etchant solutions of basic, low acid or neutral character have been proposed, these have been found wanting in one respect or another. For example, cerium sulfate or cerium nitrate salts in admixture with sulfuric acid and perchloric acid such as is proposed in British Pat. No. 1,079,607 and German Offenlegungsschrift No. 2,225,105 have succeeded in reducing undercutting to a minor extent; however, they are not significantly improved over the conventional phosphoricnitric-acetic acid etchant solutions and, because of their low acidity, require extended etching time and in many cases provide incomplete or nonuniform removal of exposed metal film. Also the slow etching rate required tends to cause lift or peeling at the edges of the resist coated metal due to mechanical weakening of the coating.

On the other hand, such etchants as the various mixtures of nitric and phosphoric acids which are strongly acidic, show definite effects of undercutting and loss of line delineation, at the boundaries of resist coated metal. When these boundaries are undercut, an indistinct, irregular or jagged line will separate the transparent and opaque areas with an attendant loss in definition of the images photographically registered thereon. Also, the undercut boundaries of the metal film are subject to cracking and crumbling thus causing shorts in the final circuitry. On the other hand, incomplete removal of metal film from desired areas causes bad connections and failure of the circuit.

Another disadvantage of previous fast etching solutions is that they cause formation of hydrogen bubbles which tend to adhere to the metal surface and boundaries of the resist thus preventing uniform or complete etching of the surface which also causes poor line delineation. Nonuniform gloss and spangling effects on metal films of higher thicknesses (25-100 u thickness) which require etching only to a limited depth (e.g. 0.1–0.5 mu depth) is usually attributed to hydrogen gas bubbles adhering to the surface during etching.

SUMMARY OF THE INVENTION

Accordingly, it is an object of this invention to provide an improved etching composition or solution for use in a microelectronic etching process which is characterized by complete removal of metal film from desired areas while avoiding undercutting and peeling of the boundaries of resist coated film.

Another object of this invention is to provide an improved etching solution for use in a photolithographic process which is capable of producing sharp, well-defined delineations between transparent areas and opaque areas.

A further object of this invention is to provide an improved etching composition for etching precision patterns which completely removes unprotected metal film of up to 7,000 mu thickness within a relatively short period of time.

Another object of this invention is to provide a novel method for effecting use of the present improved etchant solution by an efficient and economical procedure.

Still another object of this invention is to provide an etchant composition and process of application to be used in etching aluminum film for a silicon-containing substrate in a manufacture of integrated circuits.

Still another object of this invention is to provide integrated circuits having substantially no lift-off or undercutting of metal interconnectors in the circuitry and high resistance to failure.

These and other objects and advantages of the present invention will become apparent from the following description and disclosure.

According to this invention, there is provided an improved etching composition which comprises between about 65 and about 90 parts by weight phosphoric acid, between about 0.5 and about 5 parts by weight perchloric acid and between about 9 and about 30 parts by weight water. This composition is composed mainly of acids and is usefully employed at a pH below about 1.5, preferably between about 0.8 and about 1.2. It is to be understood that, in the present composition, perchloric acid per se may be employed or perchloric acid may be produced in situ by utilizing perchloric anhydride or any of the hydrates of perchloric acid. The present composition may be optionally supplemented with less than about 5% by weight, preferably from about 0.01% up to about 1.5% by weight based on total composition, of a wetting agent, most preferably a neutral or anionic wetting agent such as an ammonium or alkali metal salt of a perfluorinated hydrocarbon and carboxylic acid. Organic sulfates, sulfonates and glycols can also be employed.

Commercial products suitable as wetting agents include the fluorinated hydrocarbons supplied by Minnesota Mining and Mfg. Co. such as Wetting Agent F-126, Fluorad FC-93, Flurad FC-95 and Fluorad FC-98, all ammonium salts of perfluorinated carboxylic acids; Fluorad FC-134, fluorinated alkyl quaternary ammonium iodides and Fluorad FC-170, fluorinated alkyl polyoxyethylene ethanols. Also suitable as wetting agents are the polyalcohols, polyethers and acids supplied by GAF Corporation such as Igepal* CO 630, Igepal* CO-710, Igepal* RC-620, all alkyl phenoxy poly(ethyleneoxy) ethanols; the polyesters Autavox* BL-225 and Autavox* BL-330; the free acids of organic phosphate esters Gafac* PE-510 and Gafac* RO-660, and sodium N-methyl-N-oleyl taurate, Igepon* T-33. Still other suitable wetting agents include SXS-96, sodium xylene sulfonate supplied by Pilot Chemical Co.; anionic Monoflor 31, and nonionic Monoflor 51, Monoflor 52, and Monoflor 72, surfactants having perfluorinated alkyl groups, supplied by Imperial Chemical Industries of America; the Surfynols, acetylenic glycols, supplied by Air Reduction Chemical and Carbide Co.; Tergitol 15, Tergitol 5 and Tergitol 12, polyoxyethylene ether alcohols supplied by Union Cabide Corp., Renex 30, a polyoxyethylene ether alcohol supplied by Imperial Chemical Industries of America; amphoteric Zonyl FSB, cationic Zonyl FSC and nonionic Zonyl FSN, all hexafluoropropyl compound supplied by E. I. duPont de Nemours & Co.; Wetsit, an alkyl substituted aromatic compound supplied by Jacques Wolf and Co.; and Detergent Alkylate No. 2, a mixture of alkyl benzenes from benzene and polypropylene supplied by Atlantic Refining Co.

* registered trademark

The etching solution of the present invention can be prepared by mixing concentrated or dilute aqueous solutions of the various ingredients to make up the proportions hereinabove defined in the final mixtures.

The presence of the perchloric component is crucial in achieving advantages described above. It appears that the perchloric component promotes the formation of the metal oxide on the metal film, e.g. the formation of alumina on the surface of the aluminum metal film, and that the metal oxide is more readily etched by the phosphoric acid thus providing microscopic and molecular delineation at the boundary of the resist-coated metal film. The ease with which the phosphoric acid removes the metal oxide, continuously and actively being formed by the perchloric component, is responsible for the high etching rate and the absence of undercut and consequent peeling of the resist protected areas of the metal film.

The metal films to which the present etchant can be applied are the films of aluminum and alloys thereof containing a predominant proportion of aluminum. For the purpose of etching with the present compositions, the metal film is deposited on the substrate in a layer thickness between about 50 mu (500 A) and about 5,000 mu (50,000 A), preferably between about 200 mu (2,000 A) and about 2,500 mu (25,000 A) thickness.

Aluminum is the most commonly used metal for interconnections since, (a) it is readily evaporated, (b) it reacts chemically with the surface of a silica layer to form a strong bond between the metal and oxide films, (c) the eutectic alloy with silicon has a melting point of only 577° C, (d) the evaporated film has a high electrical conductivity which is only slightly less than that of bulk aluminum, and (e) it is a most abundant metal.

The substrates on which the metal is deposited include, glass, silicon, silica, metal, paper, film, ceramic, plastic or fibre sheets or any other conventionally employed substrate. Generally, the time required to etch the metal film depends upon the thickness of the film or the depth of etching required, and the acid concentration of the etchant composition. Usually etching will be completed in a period of from one or two seconds to 50 minutes by immersing the supported and pattern resist coated metal in a bath of the present etchant solution. More particularly, for substrates containing between 500 mu and 1,500 mu thickness of aluminum film, between about 1 and about 5 minutes provide satisfactory etching results. It will be readily understood, however, when film thicknesses as low as 50 mu are to be etched, a quick dip in the etching solution to achieve minimum contact time is all that is required. Although various techniques of contacting can be employed, contacting by immersion in the etchant bath is preferred. Oher methods such as froth etching, as described in U.S. Pat. No. 3,483,049, spray etching, or wet mat etching may also be employed if desired.

The conditions employed for the etching operation, include a temperature within the range of from about 25° to about 110° C, preferably from about 50° to about 90° C with some form of agitation in the bath being preferred. A convenient method of agitation can be effected by ultrasonic agitation or mechanical stirring. Under these conditions etching rates in the order of from about 50 mu to about 1,800 mu film thickness per minute, more usually from about 150 mu to about 1,200 mu film thickness per minute can be achieved.

The photoresists which are suitably employed in the present invention are any of those mentioned in the preceding discussion on page 2 and those set forth in the following disclosure. These are applied over the metal film in a continuous layer having a thickness of between about 50 mu and about 5,000 mu, preferably between about 100 mu and about 1,500 mu. The most preferred photoresists are those manufactured by GAF Corporation, under the trade name Microline* photoresist (an acrylic containing polymer) having an absorption spectrum between the wavelengths of 280 nm and 450 nm and utilizing exposures of between about 100 and 200 millijoules/cm$^2$ for image impression. These photoresists involve no crosslinking and are therefore employed as positive working resists. Chemically, the sensitizer of these resists are of the diazo-oxide type, such as for example N-dehydroabietyl-6-diazo5(6 H)-oxo-1-napthalene sulfonamide, with a terpolymeric binder such as those fully disclosed, including preparation and use, in U.S. Pat. No. 3,637,384; the entire disclosure of which, particularly the disclosure beginning on column 2, line 70 througn column 8, is incorporated herein by reference. It is to be understood, however, that other photoresist and chemical milling resist materials of both positive working and negative working types can be employed as protective coatings over the metal films of the present invention. The following table provides several examples of such photoresists, together with the developer used for removing desired portions after exposure to actinic light.

* registered trademark

Thus, when employing a negative photoresist, the required circuit is defined by coating an aluminum film with a continuous film of a photosensitive material (for example, any one of resins 5–10 in Table I); exposing the coating to light while covered with an image of the pattern on a mask, thereby rendering the exposed resist insoluble in the developer solution and developing in a solvent or developer to expose the metal surface in the unexposed areas where it is desirable to etch away.

TABLE I

| | Photoresist Resin | Sensitizer | Type | U.S. Pat. References* |
|---|---|---|---|---|
| 1. | Acrylic Terpolymer (ethyl acrylate, styrene, acrylic acid) | Diazo oxide | Positive | 3,637,384 |
| 2. | Acrylic resins with unsaturated side chains | Diazo oxide | Positive | U.S. Application Ser. No. 597,226 filed July 18, 1975 |
| 3. | Novolak | Diazo oxide | Positive | 3,148,983 |
| 4. | Carboxy-type acrylic resin | Diazo oxide | Positive | 3,900,325 |
| 5. | Polyvinyl cinnamate | Triphenylmethane Dye | Negative | 2,690,966 |
| 6. | Cyclized isoprene rubber derivatives | Azides | Negative | 2,852,379 |
| 7. | Esters of polyvinyl alcohol | Azides | Negative | 3,728,322 |
| 8. | Polyvinyl cinnamate + Novolak additive | Thiazoline type | Negative | 3,493,380 |
| 9. | Allyl polymers | Azides | Negative | 3,556,793 |
| 10. | Propargyl polymers | Azides | Negative | 3,657,197 and 3,725,064 |

Preferred developer solvents employed for the above positive resists are aqueous solutions of low molecular weight amines, for example, diethanolamine, diethylamine, diethylethanolamine, triethanolamine, piperidene, etc. or aqueous solutions such as sodium or potassium hydroxide, potassium carbonate or potassium phosphate.

Preferred developer solvents employed for the above negative resists are organic solvents such as toluene, xylene, methyl ethyl ketone, ethyl ketone, cyclohexanone, petroleum distillates and mixtures thereof.

*Entire disclosures of which are incorporated herein by reference.

This procedure is also followed when employing a positive photoresist (for example, any one of resins 1–4 in the above Table I) except that, in this case, the unmasked areas are removed by developer to expose the metal film in areas corresponding to a positive image of the pattern desired. It is also to be understood that, if desired, a stencil carrying a reverse pattern of the desired image can be employed over a negative resist to produce a direct copy of the desired image by exposed areas of metal film suitable for etching. These and other modifications are apparent from this description and disclosure and are within the scope of this invention.

Generally, the photoresists and developers suitable in the present process are those conventionally employed and thus many other combinations, in addition to those mentioned above and those shown in the above table, can be utilized. Additionally, any type of mask or stencil heretofore employed to register a positive or negative image of the desired pattern on the resist layer and any of the solvents conventionally used in the finishing treatment subsequent to etching can be employed in the present process. The present invention resides in the etching solution, in the manner of using the same and in the lithographic plate, printed circuit or other electronic component produced thereby.

Remarkable results achieved with the present etching solution are illustrated by the following examples which provide specific teaching of preferred embodiments of this invention, but which are not to be construed in any way limiting to the scope thereof. It is to be understood that any of the amounts and proportions given in the following examples are by weight, unless otherwise specified; and that other etchant compsitions of this invention varying within the ranges hereinabove described; and other aluminum alloy films specified above, as well as other negative or positive photoresist coatings together with their corresponding developers may be substituted in any of the following examples to achieve the advantages set forth hereinabove.

EXAMPLE 1

(comparative)

Two glass plates each having coated thereon an aluminum layer of 10,000 A thickness underlaying a coating of 10,000 A thickness of Microline PR-102 (a resin of type 1 in Table 1, supplied by GAF Corporation), were subjected to imaging with a split field test pattern imposed after 180 millijoules/cm$^2$ exposure to actinic light through a silver mask. The imaged plates were then developed by washing with Microline D-014 developer (a solution of diethylethanolamine, supplied by GAF Corporation) to leave a positive impressed pattern of uncoated aluminum film in the split field pattern ready for etching.

Two etching solutions shown in the following Table II were prepared and each was contacted with one of the developer treated plates by immersion of the plate in the respective etching solutions.

TABLE II

| SOLUTION 1 | | SOLUTION 2 | |
|---|---|---|---|
| Phosphoric acid | 80 parts | Phosphoric acid | 80 parts |
| Nitric acid | 5 parts | Perchloric acid | 1 part |
| Acetic acid | 5 parts | Water | 19 parts |
| Water | 10 parts | | |

AT 60° C, Solution 1 completely removed the photoresist layer in less than 0.5 minutes. Solution 2 etched through the exposed aluminum layer in 3.5 minutes, but had no effect whatever on the unexposed photoresist coated portions of the metal film. Consequently, no undercutting of lifting of the aluminum film in unexposed portions was detected with Solution 2. The plate immersed in Solution 2 was allowed to remain in the bath for a total of 12 minutes, after which it was reexamined. It was found that still no effect on the unexposed photoresist coated portions of the metal was evident and the line delineation between exposed and coated areas was of an exceptionally high resolution.

EXAMPLE 2

(comparative)

Example 1 was repeated except that Microline PR-435 (a resin of type 1 in Table 1, supplied by GAF Corporation) was substituted for Microline PR-102. Solution 1a which is identical with Solution 1 above, again stripped off the entire resist coating in less than 0.5 minutes. Solution 2a which is identical with Solution 2 above, showned no affect on the unexposed coated portions of the metal after 16 minutes; and high line resolution at the boundaries of exposed and coated portions of the imaged plate was obtained.

EXAMPLE 3

A solution of photoresist, i.e. Microline PR-102, about 600 mu thickness, was coated on each of two aluminum clad glass plates having metal film thickness of about 700 mu and imaged and developed as in Example 1. A small amount (0.04% by weight) of a wetting agent, i.e. Fluorad FC-93 (an ammonium salt of a perfluorinated acid, supplied by Minnesota Mining and Manufacturing Corporation) was added to a solution identical with Solution 2 of Example 1. One of the imaged plates having the aluminum film exposed in the developed portions was placed in this composition while the other similar plate was placed in a solution identical with Solution 2 of Example 1. Both solutions were maintained at 70° ± 1° C for 3.5 minutes, after which the plates were removed and examined under a microsocpe. Although neither plate revealed undercutting to the naked eye, inspection under the microscope revealed that the etching solution devoid of wetting agent experienced some slight undercutting effect at a few areas of the coated film. However, the plate which was etched in the bath containing Fluorad FC-93 showed practically no undercutting. Neither sample showed any evidence of aluminum film peel in the unexposed areas and all lines of the pattern, represented by the exposed portions, were completely etched.

EXAMPLE 4

A solution of Shipley AZ-111 (a mixture of hovolak resins and diazo oxides) in a thickness of about 2,000 mu, was coated on two aluminum clad glass plates having a metal film thickness of about 2,000 mu and the coated plate was imaged with a split field test pattern imposed by 200 millijoules/cm$^2$ exposure to actinic light through an apertured chromium mask. The coated plate was then developed with an aqueous solution of potassium carbonate to expose the metal film in the exposed areas. About 0.05% by weight of an anionic fluorocarbon surfactant (Fluorad FC-98) was added to a solution of 85 parts by weight phosphoric acid, 3 parts by weight perchloric acid and 12 parts by weight water. One of the imaged plates having the aluminum film exposed in a positive image on the developed portion was immersed in the etching solution and the solution maintained at 75° C for 2.5 minutes, after which the plate was removed and examined under a microscope. Upon inspection, it was found that the etching solution had completely removed the metal film in the exposed areas without any noticeable undercutting of the Shipley AZ-111 photoresist.

The remaining developed plate was immersed in a similar etching solution except that the wetting agent was omitted and the same etching procedure followed. After 2.5 minutes etching time no undercutting of the resist layer was noted and the metal film in the exposed areas was completely removed.

Both of the above etching baths are suitable for additional etching of aluminum film and can be used until the perchloric acid content falls below and 0.5%, after which the solution can be regenerated by filtering off solids and oxidizing to regenerate perchloric acid or simply by addition of perchloric acid.

EXAMPLE 5

The same etching solution as employed in Exaple 3 with wetting agent was used to etch an aluminum clad glass plate having a metal film thickness of 700 mu, coated with a negative photoresist solution of Kodak KMER (resin 6 in Table I) of about 700 mu thickness which had been imaged by UV light through a silver mask and developed with xylene to expose aluminum film in a reverse image of the mask pattern. After immersion in the bath at 80° C for a period of 4 minutes, the aluminum coated plate was etched and removed for examination. Inspection under the microscope revealed that the etching solution had completely and uniformly etched the exposed portions of aluminum film with no evident undercutting of the Kodak KMER photoresist.

Having thus described our invention, we claim:

1. A composition for etching an aluminum film or alloys thereof containing a predominant proportion of aluminum, said composition consisting of between about 65 and about 90 parts by weight phosphoric acid, between about 0.5 and about 5 parts by weight of a perchloric component selected from the group consisting of perchloric acid, perchloric anhydride and a perchloric hydrate, and between about 9 and about 30 parts by weight water, and from 0 to about 5% by weight of a neutral or anionic wetting agent.

2. The composition of claim 1 wherein the perchloric component is perchloric acid.

3. The composition of claim 1 wherein the composition contains between about 0.01% up to about 1.5% by weight wetting agent and said wetting agent is a fluorinated hydrocarbon.

4. The composition of claim 3 wherein the wetting agent is an alkali metal, or an ammonium, salt of a perfluorinated carboxylic acid.

5. The composition of claim 1 wherein the composition contains no wetting agent.

6. A process for selectively etching an exposed area of aluminum or aluminum alloy metal film deposited on a substrate and having an exposed area and a resist coated area, which comprises contacting said exposed area of metal film with the etching composition of claim 1.

7. The process of claim 6 wherein the metal film on the substrate and the resist coating are each between about 50 mu and about 5,000 mu thick.

8. The process of claim 7 wherein the resist coating is a negative working photoresist.

9. The process of claim 7 wherein the resist coating is a positive working photoresist.

10. The process of claim 9 wherein the positive working photoresist is an acrylic type polymer having a diazo oxide sensitizer.

11. The process of claim 6 wherein the thickness of the metal film on the substrate is between about 200 mu and about 2,500 mu and the thickness of the resist coating is between about 100 mu and about 1,500 mu.

12. The process of claim 6 wherein the etching with the composition of claim 1 is carried out at a temperature between about 25° C and about 110° C.

13. The process of claim 12 wherein the etching rate is between about 50 mu and about 1,200 mu film thickness per minute.

14. The process of claim 6 wherein the composition of claim 1 is employed at a pH below about 1.5.

15. The process of claim 6 wherein the metal film is an aluminum film which is deposited on the substrate by the process of evaporation.

* * * * *